US008904571B2

(12) United States Patent
Moore

(10) Patent No.: US 8,904,571 B2
(45) Date of Patent: Dec. 9, 2014

(54) FRESH FLUSH RECYCLING TOILET

(76) Inventor: Jeffrey O. Moore, Boise, ID (US)

( * ) Notice: Subject to any disclaimer, the term of this patent is extended or adjusted under 35 U.S.C. 154(b) by 454 days.

(21) Appl. No.: 12/782,973

(22) Filed: May 19, 2010

(65) Prior Publication Data

US 2011/0030802 A1 Feb. 10, 2011

Related U.S. Application Data

(60) Provisional application No. 61/231,712, filed on Aug. 6, 2009.

(51) Int. Cl.
*E03D 5/016* (2006.01)
*E03D 7/00* (2006.01)

(52) U.S. Cl.
CPC . *E03D 5/016* (2013.01); *E03D 7/00* (2013.01)
USPC ..... 4/317; 4/321; 4/364

(58) Field of Classification Search
USPC ..... 4/321, 317–318, 364
See application file for complete search history.

(56) References Cited

U.S. PATENT DOCUMENTS 3,501,778 A * 3/1970 Helke et al. ..... 4/317
3,634,891 A * 1/1972 Kemper ..... 4/317
3,738,489 A * 6/1973 Kraemer, II ..... 210/94
3,824,632 A * 7/1974 Bach et al. ..... 4/318
3,873,445 A * 3/1975 Bussard ..... 210/149
4,115,876 A * 9/1978 Cole et al. ..... 4/137
4,117,560 A * 10/1978 Kidon et al. ..... 4/321
4,504,983 A * 3/1985 Goodyer ..... 4/321
5,045,188 A * 9/1991 Tsai ..... 210/136
5,282,281 A 2/1994 Clear
5,500,960 A 3/1996 Tagg
5,913,610 A * 6/1999 Duck ..... 4/321
6,721,967 B2 4/2004 Braxton
6,743,361 B1 * 6/2004 Doege et al. ..... 210/605
7,725,961 B2 * 6/2010 Martinez et al. ..... 4/321

* cited by examiner

*Primary Examiner* — Janie Christiansen
(74) *Attorney, Agent, or Firm* — Robert L. Shaver; Dykas & Shaver

(57) ABSTRACT

A portable toilet system is provided having an enclosed housing and including a tank upon which a toilet seat and bowl is positioned. The tank has two sections divided by a wall. Waste drops into the first section where it is accumulated for collection. The dividing wall does not extend to the top of the tank. The second section is initially filled with fresh water. A pump draws water through a hose or pipe submersed in the second section. That water is flushed into the toilet bowl to rinse waste into the first section. As the water in the second section is depleted, the liquid waste deposited in the first section overflows the dividing wall into the second section of the tank to recycle the liquid waste and extend the period before servicing of the system is necessary.

18 Claims, 4 Drawing Sheets

FRESH FLUSH RECYCLING TOILET

CROSS-REFERENCE TO RELATED APPLICATION

This application claims the benefit of provisional patent application Ser. No. 61/231,712, filed 6 Aug. 2009, by the present inventor, Jeffrey O. Moore, which is incorporated herein by reference.

BACKGROUND

This invention relates to recycling flush toilet systems. The invention may be used in portable toilet systems, and in other locations where running water is not available or is only available in a limited supply such as aboard airplanes, boats and trailers, or in a basement or a cabin, etc. Conventional portable or transportable toilet units are typically used at construction sites, outdoor public events and various other venues where a running water supply is unavailable. These systems generally comprise a housing within which a waste material storage tank is positioned. A toilet structure is formed on the top of the tank and opens into the tank for gravity collection of toilet waste material and subsequent removal of accumulations of that material from the tank.

The housings of the portable toilet systems are usually made of large sheets of plastic materials which are formed into rear and side walls and a front wall having a doorway and a suitable door, a roof and a floor.

The waste material holding tank which is also formed of plastic material, is normally positioned within the housing and occupies a portion of the floor space. The toilet waste material drops, under the influence of gravity, into the tank where it is accumulated for collection. Typically, the accumulated waste within the holding tank is removed, from time to time, by inserting a pipe, through the toilet opening, into the tank and (vacuuming) pumping the accumulated waste material into a suitable tank-truck for removal of the waste to a waste disposal and processing center.

Examples of known portable toilet units are disclosed in U.S. Pat. No. 3,447,167 Harding, U.S. Pat. No. 3,835,480 to Harding, U.S. Pat. No. 4,031,572 to Harding, U.S. Pat. No. 4,577,351 to Harding, U.S. Pat. No. 4,831,671 to Harding, U.S. Pat. No. 4,918,765 to Harding, and U.S. Pat. No. 3,435,464 to Harding.

Although prior art portable toilet units are satisfactory for their purposes, the public has become accustomed to the use of indoor flush-type toilets, so that flush-type toilets are preferred. Flush toilet systems are more sanitary, less unsightly and reduce the offensive odors associated with non-flush toilets.

Examples of portable flush toilet systems are disclosed in U.S. Pat. No. 5,500,960 to Tagg, U.S. Pat. No. 5,913,610 to Duck and U.S. Pat. No. 6,721,967 to Braxton. One of the drawbacks of portable flush toilet systems is that a fresh water supply is required to enable the flushing mechanism. The fresh water supply is limited by the size of the fresh water tanks supplied. Once the fresh water supply is exhausted, it is necessary to empty the waste tank and replenish the fresh water. It is desirable to provide a flushing system in which the supply of flushable water can be extended to increase the time between servicing without substantially changing the construction of the toilet housing. The invention of the present application addresses these problems and provides an improved fresh flush recycling toilet system.

SPECIFICATIONS

Detailed Description of the Invention

Figure 1:
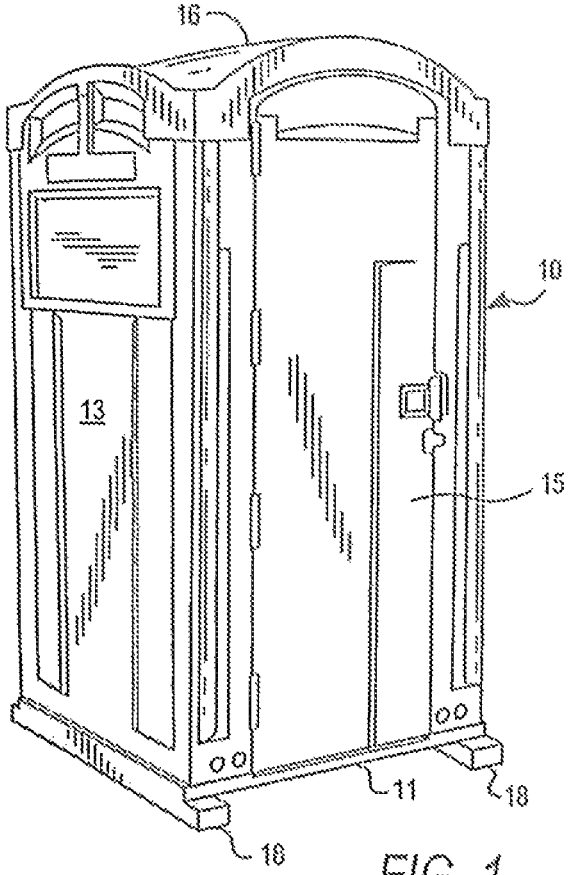
FIG. 1 is a perspective front and side view of a recycling flush toilet housing.
Figure 2:
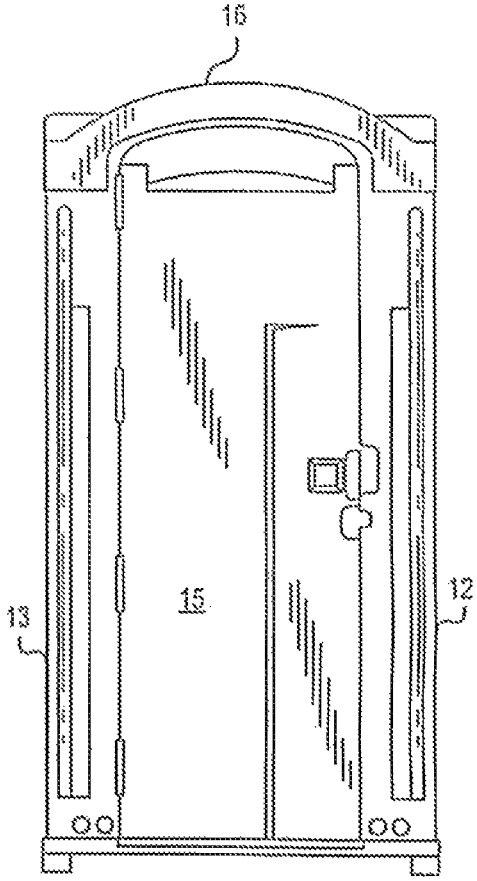
FIG. 2 is a front elevational view of the housing.
Figure 3:
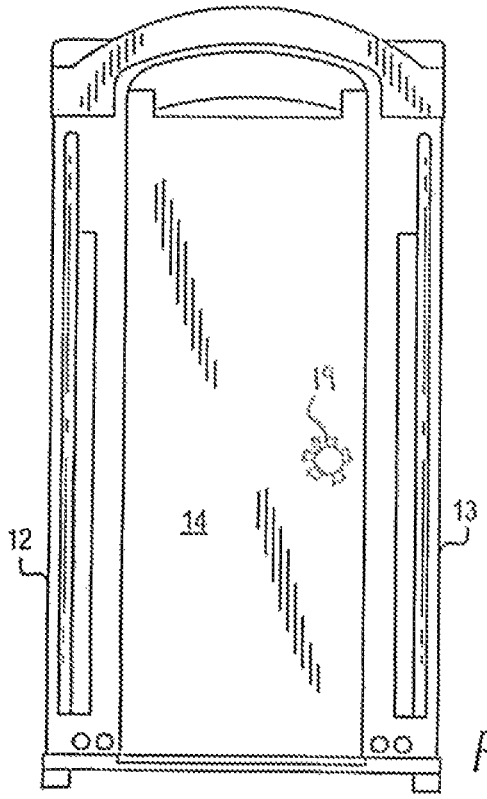
FIG. 3 is a rear elevational view of the housing.
Figure 4:
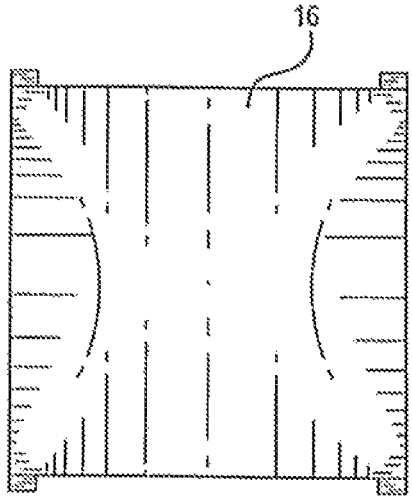
FIG. 4 is a top, plan view of the housing.

As shown in the FIGS. 1-4, a fresh flush recycling toilet system 10 of the portable variety includes a base or pallet 11, opposing side walls 12 and 13, a rear wall 14, a door 15 and a roof 16. A combined toilet and tank 17 is positioned within housing 10. Along the bottom of housing 10 are skid plates 18 that make it easier to move the housing when transport of housing 10 is required.

A toilet and tank component 17 is shown in FIGS. 5-10. Toilet and tank component 17 is formed with opposed side walls 90 and 91 and a rear wall 92. The side walls are preferably shaped to closely match the interior surfaces of the housing walls 12 and 13.

The bottom panel 95 of tank 17 (see FIG. 8) is formed along the bottom of housing 10 above skid plate 18. Tank 17 is closed with an upper, closure panel 96 which has a depressed portion 97 integrally connected to the main body of the upper panel by an integral flange-like strip 98. In addition, the tank has a front wall 99 having a middle portion 100 which is angled relative to opposite side portions 101 and 102 of front wall 99.

The toilet 72 has a forward, partial bowl-like portion 105 which extends forwardly of the middle portion 100 of the front wall. The toilet also contains waste direction tube 21 which directs the flushed waste at an angle away from a user in order to prevent splashing of the waste liquid. It should be understood that the relative positioning of the different components of the system presented in the drawings are but one configuration that is workable for the fresh flush recycling toilet of the present invention. It should be understood that a multitude of different configurations placing the toilet elsewhere on the tank is possible and will not in any way interfere with the workings of the present invention.

In the configuration defined above, the forward-most portion of the bowl-like portion of the toilet is roughly in the plane of the side portions 101 and 102 of the front wall 99 of the tank. The distances from the forward-most point of the bowl-like portion of the toilet to the surface of the middle wall section 100, are approximately equal on both sides of the toilet so that the use of space in housing 10 is efficient.

Figure 6:
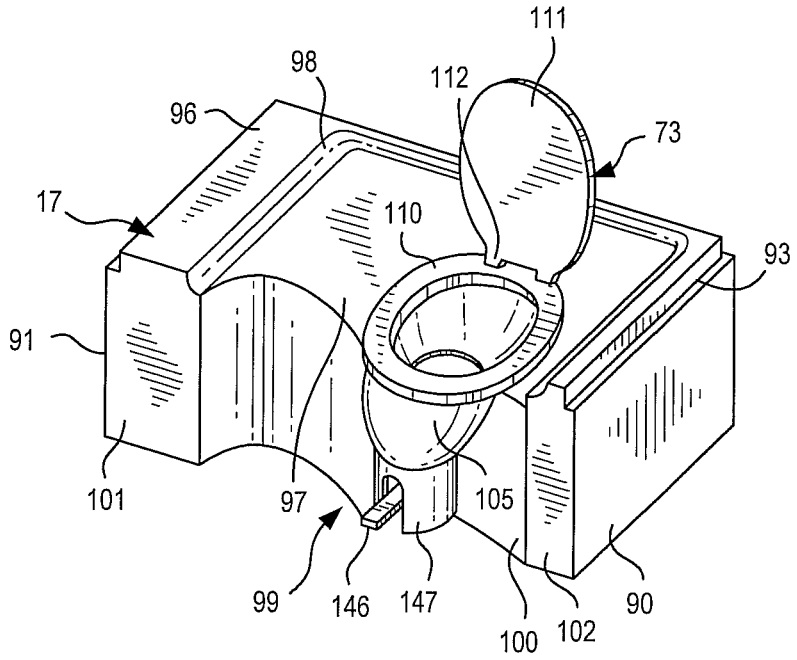
FIG. 6 is a perspective view illustrating the tank and toilet structure.
Figure 7:
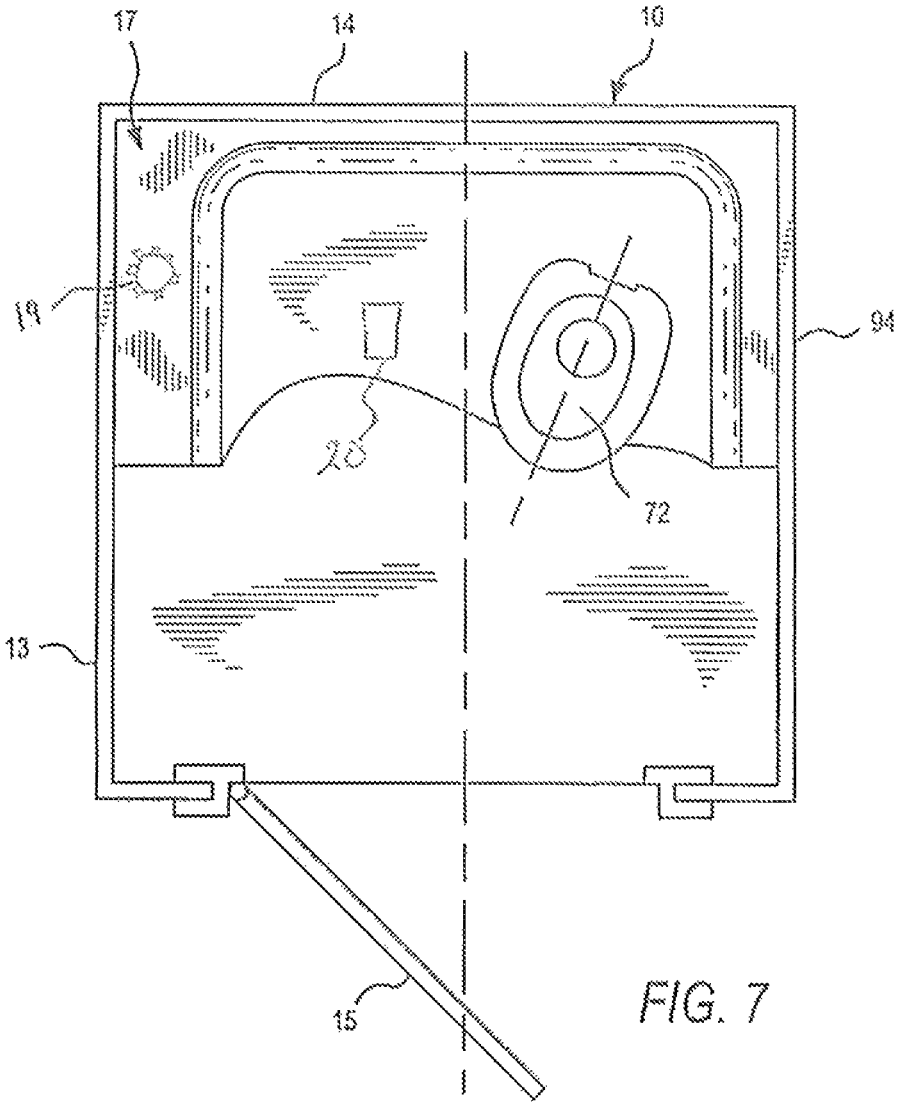
FIG. 7 is a schematic, plan view, in cross-section, of the housing and the holding tank and toilet structure positioned within the housing, drawn to a reduced scale.
Figure 8:
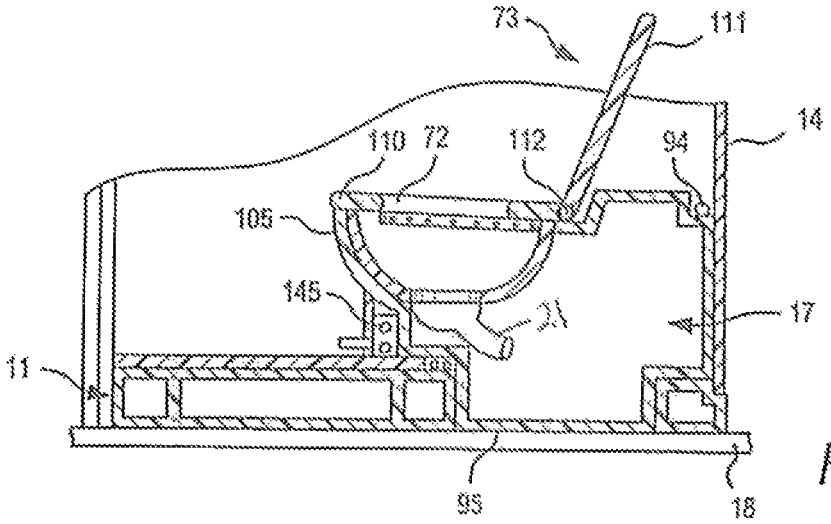
FIG. 8 is an enlarged, cross-sectional view showing the tank and toilet structure, illustrated schematically, positioned within the housing.
Figure 9:
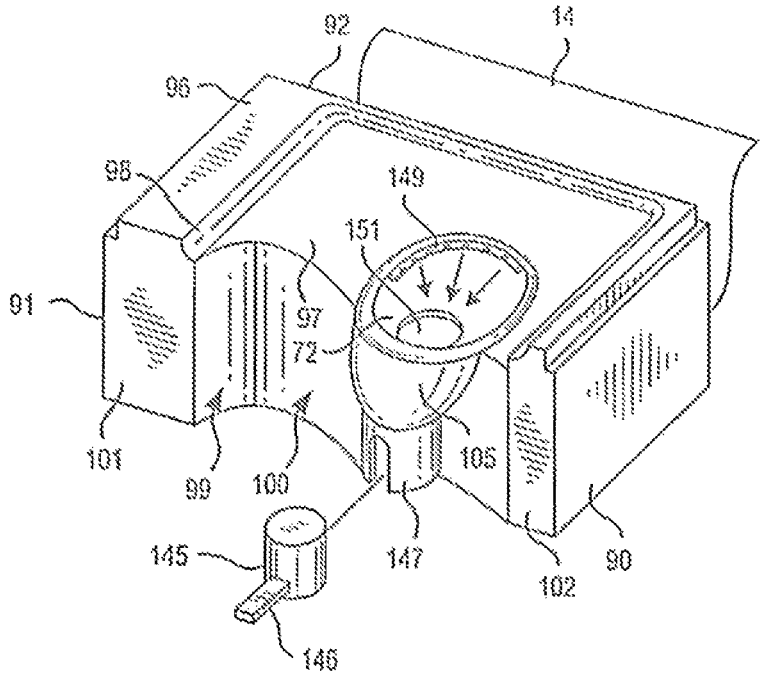
FIG. 9 is a perspective view of the tank and toilet structure with the plumbing pipes and pump parts illustrated schematically.

The toilet seat-cover unit 73 may be formed of a conventional toilet seat 110 and a suitable, correspondingly shaped and sized cover or lid 111. The cover and lid are connected together and to the tank by conventional hinges 112. Thus, for use, the toilet lid 111 may be swung upwardly, as illustrated in FIG. 6, to expose the seat 110. The partial bowl-like extension of the toilet, extending forwardly and spaced on either of its sides approximately equidistantly from the front wall section with which it is joined.

The tank may be periodically cleaned by inserting the end of a pipe through the toilet opening into the tank and connecting the opposite end of the pipe to a waste removal truck for pumping out the contents of the tank. This is a conventional system for cleaning toilets of this type.

Figure 5:
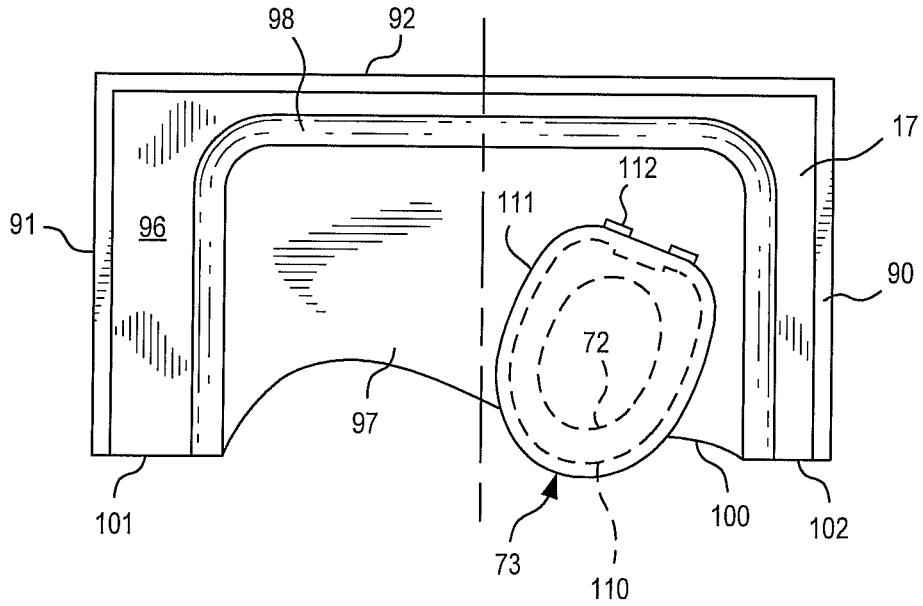
FIG. 5 is a top, plain view of the tank and toilet structure inside the housing.

Toilet and tank component 17 is formed with opposed side walls 90 and 91 and a rear wall 92 as shown in FIG. 5. The side walls are preferably shaped to closely match the interior surfaces of housing walls 12 and 13 (see FIGS. 6 and 7).

The tank is closed with an upper, closure panel 96 which has a depressed portion 97 integrally connected to the main body of the upper panel by an integral flange-like strip 98.

Figure 10:
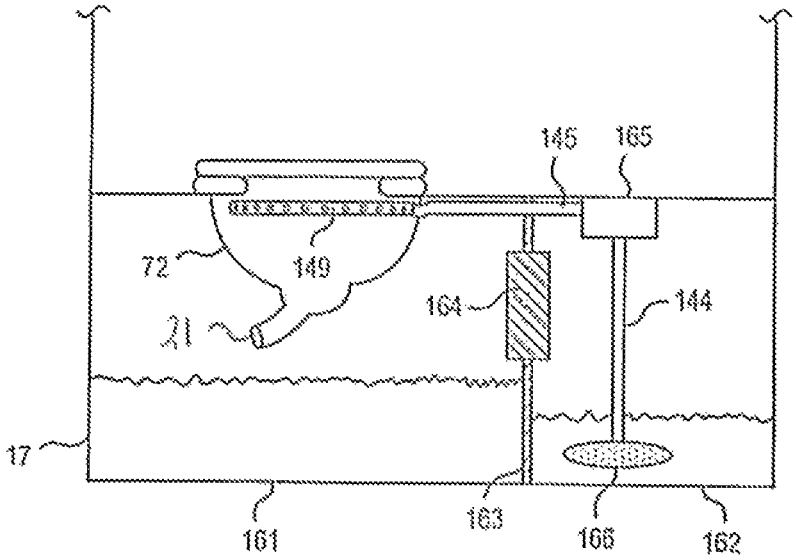
FIG. 10 is a cut-away perspective view of the housing showing the toilet and the two section tank.

FIG. 10 shows a rear cut-away view of toilet and tank component 17. The tank is divided into two sections. The first section 161 is for collecting solid and liquid waste while the second section 162 is used to hold water for flushing the toilet 72. The toilet is positioned above first section 161 so that after the toilet is used and flushed, liquid and solid waste are deposited in first section 161. A waste direction tube, shown in FIGS. 8 and 10, can be added to the bottom side of toilet 72 to decrease splashing as the waste is deposited into tank component 17. The waste direction tube can be many shapes, with a curving funnel shape being preferred to direct waste away from immediately beneath a user and reduce the vertical speed of the waste. In an initial state when the portable toilet unit is deployed at a site, second section 162 is filled with fresh water to a level just below the height of a solid vertically oriented wall 163 running between front wall 99 and rear wall 92 along bottom 95 of tank 17. Between the top of solid vertically oriented wall 163 and closure panel 96 which forms the ceiling of tank 17, a filter mechanism 164 may be situated to prevent solid waste from moving into second section 162 from first section 161. Filter mechanism 164, however, can be removed to form a gap above wall 163 wherein waste water can flow from first section 161 and into second section 162 once first section 161 reaches its maximum capacity.

After each flush of toilet 72, fresh water from second section 162 is pumped up supply pipe 144 by pump 165 and out outlet pipe 145 into toilet 72 through flush mechanism 149 causing waste to flow down out of toilet bowl 72 and into first section 161 of tank 17. Pump 165 is activated manually by operating foot lever 146 (FIG. 6). In the embodiment of FIG. 6, the lever is a foot lever that moves up and down by applying foot pressure. The pump is arranged within a bulged housing 147 formed at the front of the tank and beneath the toilet bowl extension 105. Various types of commercially available hand, foot and other manually activated pumps are well known and not disclosed in detail here. Any such pump can be configured to perform the task of pumping the water from second section 162 and can be located at various positions within reach of the individual using the toilet to start the flushing cycle. Alternatively, an electrically operated pump may be used provided a supply of electricity or battery power is available. As a third alternative, hand pump 20 can be used in place of pump 165.

The bowl opening 151 may be provided with flap-type covers or the like (not shown) which normally close the opening and which open during flushing. Various types of commercially available mechanisms can be used for this purpose and, therefore, a detailed mechanism is not illustrated here. Rather, any suitable closure mechanism may be used or, alternatively, the opening may be left without a closure.

Housing 10 is typically moved to a site for use in an empty state. Second section 162 may initially be filled or later refilled with fresh water through a capped hole in the outside surface of housing 10 (not shown) or through another port on tank 17 inside housing 10.

As the fresh water supply in second section 162 is used and depleted during flushes, it is deposited through the flushing cycle into first section 161 along with solid and liquid waste. Once the level of waste water in first section 161 exceeds the top of solid vertically oriented wall 163, the waste water, supernatant liquid, flows over the top of wall 163 through filter mechanism 164, or a gap if filter mechanism 164 is removed, at the top of vertically oriented wall 163 which is a common wall between the two sections and combines with any remaining fresh water in second section 162 to extend the cycle time of flushable water in the system until the recyclable flush toilet is serviced. A second, finer filter mechanism 166 may also be included (although it is not required) at the inlet of supply pipe 144 to help ensure that solid waste is not passed through the pump and flushing mechanism during the flushing cycle.

Servicing the system requires that first section 161 be emptied. This is typically done by inserting a vacuum hose into first section 161 through toilet bowl 72. During the same service visit, second section 162 is also emptied and refilled with clean, fresh water.

The amount of water contained in second section 162 of tank 17 should be less than the amount of storage capacity of the waste material storage tank, first section 161, to avoid overflowing the fresh water from second section 162 back into first section 161.

It is to be understood that the above descriptions and drawings are only for illustrating limited variations of the present invention and are not intended to limit the scope of the invention. In particular, FIGS. 1-4 show a portable toilet system housing in which the invention may be used. However, it should be understood that the invention may also be implemented in other locations where clean water is unavailable or is only available in limited supply such as aboard airplanes, boats and trailers, or in a basement or cabin, etc. Any variation or derivation from the above description and drawings are included in the scope of the present invention.

What is claimed is:

1. A portable, flushable toilet apparatus, said apparatus comprising:

a housing with a base, four housing walls, and a roof, said base having a bottom with skid plates for portability, at least one of said housing walls comprising a door, a tank atop said base and within said housing walls, said tank having a ceiling, a bottom panel, a rear wall, a front wall, and two opposing side walls, said tank comprising a first section for waste collection and a second section for holding fresh water, said first section separated from said second section by a common wall joined to said bottom panel, without a gap between said common wall and bottom panel, said common wall with a top, said common wall connected to and disposed in a plane normal to said bottom panel, said top of said common wall and said ceiling defining a gap between said top and ceiling, said second section having a refilling hole with a removably affixable cap;

a toilet bowl positioned within said ceiling of said tank, above said first section; and a flush assembly comprising a flush mechanism connected to said toilet bowl, a supply pipe, a pump with a suction side and an outlet side, and an outlet pipe, with said flush assembly having a fresh water flush capability and a contaminated water flush capability;

said supply pipe connected to said suction side of said pump, and with said outlet pipe connected to said outlet side of said pump, said pump in fluid communication with said second section through said supply pipe and in fluid communication with said flush mechanism through said outlet pipe, said flush mechanism in fluid communication with said first section through said toilet bowl, said first section in fluid communication with said second section through said gap between said top of said common wall and said ceiling;

wherein said flush assembly is configured to send a plurality of fresh water flushes to said toilet bowl with the fresh water contents of said second section, with said first section configured to have capacity to receive a plurality of flushes before the contents of said first section overflows over said top of said common wall into said second section, after which time said flush assembly is configured to flush said toilet bowl from said second section into said toilet bowl with supernatant liquid from said first section mixed with remaining fresh water contents of said second section.

2. The toilet apparatus of claim 1 wherein the pump is a foot-operated pump.

3. The toilet apparatus of claim 1 wherein the pump is a hand-operated pump.

4. The toilet apparatus of claim 1 wherein the pump is an electrically operated pump.

5. The toilet apparatus of claim 1 that further comprises a filter mechanism situated in said common wall, wherein said filter mechanism prevents solid waste from passing from said first section to said second section.

6. The toilet apparatus of claim 1 that further comprises a filter mechanism connected to said supply pipe, opposite the connection between said supply pipe and said pump.

7. A method of operating a portable, flushable toilet apparatus, the method comprising the steps of:

(a) providing a portable, flushable toilet apparatus comprising a toilet and tank component having a tank with a first section and a second section, the sections separated by a common wall joined at the bottom panel of said tank, said common wall with a top, a toilet bowl disposed above said first section, and a refilling hole in said second section, wherein said first and second sections are in fluid communication by way of a gap above said top of said common wall;

(b) filling said second section with a quantity of fresh water such that the fresh water does not overflow said top of said common wall;

(c) pumping a portion of said fresh water from said second section into said toilet bowl;

(d) flushing said toilet bowl with said fresh water;

(e) receiving in said first section waste and fresh water from said toilet bowl by way of gravity;

(f) flushing said toilet bowl with said fresh water from said second section;

(g) receiving in said first section waste and fresh water from said toilet bowl by way of gravity;

(h) providing in said first section capacity for receiving a plurality of flushes of waste plus fresh water from said second section;

(i) providing for overflow of supernatant liquid from said first section into said second section by way of said gap above said top of said common wall;

(j) mixing said supernatant liquid with remaining fresh water of said second section;

(k) pumping a portion of mixed supernatant and fresh water from said second section into said toilet bowl;

(l) flushing said toilet bowl with said mixed supernatant and fresh water;

(m) receiving in said first section waste and said mixed supernatant and fresh water from said toilet bowl by way of gravity; and (n) servicing said toilet apparatus by inserting a vacuum hose into said tank and removing the contents therefrom.

8. The method of claim 7 further comprising, between steps (i) and (j), the step of filtering said supernatant liquid.

9. The method of claim 7 further comprising, between steps (j) and (k), the step of filtering said mixed supernatant liquid and fresh water.

10. The method of claim 7 wherein a non-potable fluid is used in lieu of fresh water.

11. The method of claim 7 wherein said first section has a greater volume than said second section.

12. The method of claim 7 wherein pumping is performed with a foot-operated pump.

13. The method of claim 7 wherein pumping is performed with a hand-operated pump.

14. The method of claim 7 wherein pumping is performed with an electrically operated pump.

15. The method of claim 7 wherein the portable, flushable toilet apparatus further comprises a portable housing, said housing containing said toilet and tank component.

16. A method of operating a portable, flushable toilet apparatus, the method comprising the steps of:

(a) providing a portable, flushable toilet apparatus, said apparatus comprising:

a housing with a base, four housing walls, and a roof, said base having a bottom with skid plates for portability, at least one of said housing walls comprising a door, a tank atop said base and within said housing walls, said tank having a ceiling, a bottom panel, a rear wall, a front wall, and two opposing side walls, said tank comprising a first section for waste collection and a second section for holding fresh water, said first section separated from said second section by a common wall joined to said bottom panel, without a gap between said common wall and bottom panel, said common wall with a top, said common wall connected to and disposed in a plane normal to said bottom panel, said top of said common wall and said ceiling defining a gap between said top and ceiling, said second section having a refilling hole with a removably affixable cap;

a toilet bowl positioned within said ceiling of said tank, above said first section; and a flush assembly comprising a flush mechanism connected to said toilet bowl, a supply pipe, a pump with a suction side and an outlet side, and an outlet pipe;

said supply pipe connected to said suction side of said pump, said outlet pipe connected to said outlet side of said pump, said pump in fluid communication with said second section through said supply pipe and in fluid communication with said flush mechanism through said outlet pipe, said flush mechanism in fluid communication with said first section through said toilet bowl, said first section in fluid communication with said second section through said gap between said top of said common wall and said ceiling;

wherein said flush assembly is configured for multiple flushes of said toilet bowl with fresh water flushes from the contents of said second section until the contents of said first section overflows over said top of said common wall into said second section, then said flush assembly flushes said toilet bowl from said second section into said toilet bowl with supernatant liquid from said first section mixed with remaining fresh water contents of said second section;

(b) filling said second section with a quantity of fresh water such that the fresh water does not overflow said top of said common wall;

(c) pumping a portion of said fresh water from said second section into said toilet bowl;

(d) flushing said toilet bowl with said fresh water;

(e) receiving in said first section waste and fresh water from said toilet bowl by way of gravity;

(f) flushing said toilet bowl with said fresh water from said second section at least a second time;

(g) receiving in said first section waste and fresh water from said toilet bowl by way of gravity for at least a second time;

(h) overflowing said supernatant liquid from said first section into said second section, after multiple fresh water flushes, by way of said gap above said top of said common wall;

(i) mixing said supernatant liquid with remaining fresh water of said second section;

(j) pumping a portion of mixed supernatant and fresh water from said second section into said toilet bowl;

(k) flushing said toilet bowl with said mixed supernatant and fresh water;

(l) receiving in said first section waste and said mixed supernatant and fresh water from said toilet bowl by way of gravity; and (m) servicing said toilet apparatus by inserting a vacuum hose into said tank and removing the contents therefrom.

17. The method of claim 16 further comprising, between steps (h) and (i), a step of filtering said mixed supernatant liquid and fresh water.

18. The method of claim 16 wherein pumping is performed with a foot-operated pump.

* * * * *